US008155559B2

(12) United States Patent
Hayakawa

(10) Patent No.: US 8,155,559 B2
(45) Date of Patent: Apr. 10, 2012

(54) IMAGE-FORMING DEVICE

(75) Inventor: Shigeki Hayakawa, Kariya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 374 days.

(21) Appl. No.: 12/398,557

(22) Filed: Mar. 5, 2009

(65) Prior Publication Data

US 2009/0226212 A1 Sep. 10, 2009

(30) Foreign Application Priority Data

Mar. 5, 2008 (JP) ..... 2008-055014
Mar. 5, 2008 (JP) ..... 2008-055015

(51) Int. Cl.
*G03G 15/08* (2006.01)

(52) U.S. Cl. ..... 399/121; 399/124; 399/303

(58) Field of Classification Search ..... 399/110, 399/121, 124, 162, 165, 303; 474/101
See application file for complete search history.

(56) References Cited

U.S. PATENT DOCUMENTS

| | | | | |
|---|---|---|---|---|
| 6,115,568 | A | 9/2000 | Sameshima | |
| 6,999,709 | B2 * | 2/2006 | Park | 399/302 |
| 2007/0048005 | A1 | 3/2007 | Nakano et al. | |
| 2007/0048010 | A1 | 3/2007 | Nakano | |

FOREIGN PATENT DOCUMENTS

| | | |
|---|---|---|
| CN | 1920693 A | 2/2007 |
| JP | 10-301464 | 11/1998 |
| JP | 2007-55774 | 3/2007 |
| JP | 2007-57952 | 3/2007 |
| JP | 2007-101728 | 4/2007 |

OTHER PUBLICATIONS

Chinese Official Action dated Dec. 31, 2011 together with English language translation.
Japanese Office Action dated Feb. 9, 2010 with translation.
Chinese Official Action dated Jun. 23, 2011 from CN 200910126454.2 together with an English language translation.

* cited by examiner

*Primary Examiner* — David Porta
*Assistant Examiner* — Benjamin Schmitt
(74) *Attorney, Agent, or Firm* — Scully, Scott, Murphy & Presser, PC

(57) ABSTRACT

An image-forming device includes a body frame having a first contacting part and a second contacting part; and a belt unit detachably mounted in the body frame. The belt unit includes a belt unit main frame, a first roller, a second roller, a belt, a belt unit side frame, a handle part, a first contacted part, and a second contacted part. The belt unit side frame is attached to the belt unit main frame. The handle part is disposed at the belt unit main frame. The first contacted part is provided on the handle part to contact the first contacting part. The second contacted part is provided on one of the belt unit main frame and the belt unit side frame to contact the second contacting part. The second contacted part is closer to the second roller than the first roller.

16 Claims, 11 Drawing Sheets

IMAGE-FORMING DEVICE

CROSS REFERENCE TO RELATED APPLICATION

This application claims priorities from Japanese Patent Application No. 2008-055014 filed at Mar. 5, 2008 and from Japanese Patent Application No. 2008-055015 filed at Mar. 5, 2008. The entire content of each of these priority applications is incorporated herein by reference.

TECHNICAL FIELD

The present invention relates to an image-forming device.

BACKGROUND

A conventional image-forming device disclosed in Japanese unexamined patent application publication No. 2007-101728 includes a belt unit (transfer unit) having a belt mounted around two rollers, and a main body frame in which the belt unit is detachably mounted. The belt unit has a handle that the user or service technician grips when mounting or removing the belt unit.

In the invention disclosed in Japanese unexamined patent application publication No. 2007-101728, the belt unit is fixed to the main body frame by a distal end part of the handle extending upward from the belt unit, and support parts projecting toward the side surfaces of the belt unit from the handle.

SUMMARY

In view of the above-described drawbacks, it is an objective of the present invention to provide a novel construction for detachably mounting the belt unit in the main body frame.

In order to attain the above and other objects, the present invention provides an image-forming device including a body frame having a first contacting part and a second contacting part; and a belt unit detachably mounted in the body frame. The belt unit includes a belt unit main frame, a first roller, a second roller, a belt, a belt unit side frame, a handle part, a first contacted part, and a second contacted part. The belt unit main frame has a first main end portion and a second main end portion in a first direction and a third main end portion and a fourth main end portion in a second direction orthogonal to the first direction. The first roller is disposed at the first main end portion. The second roller is disposed at the second main end portion. The belt is mounted around the first roller and the second roller. The belt unit side frame is attached to at least one of the third main end portion and the fourth main end portion. The handle part is disposed at the first main end portion. The first contacted part is provided on the handle part to contact the first contacting part. The second contacted part is provided on one of the belt unit main frame and the belt unit side frame to contact the second contacting part. The second contacted part is closer to the second roller than the first roller.

Another aspect of the present invention provides An image-forming device includes a body frame having a first contacting part and a second contacting part; and a belt unit detachably mounted in the body frame. The belt unit includes a belt unit main frame, a first roller, a second roller, a belt, a belt unit side frame, a handle part, and a holding unit. The belt unit main frame has a first main end portion and a second main end portion in a first direction and a third main end portion and a fourth main end portion in a second direction orthogonal to the first direction. The first roller is disposed at the first main end portion. The second roller is disposed at the second main end portion. The belt is mounted around the first roller and the second roller. The belt unit side frame is attached to at least one of the third main end portion and the fourth main end portion. The handle part is disposed at the first main end portion. The holding unit is provided in the handle part to hold a position of the belt unit for the frame.

BRIEF DESCRIPTION OF THE DRAWINGS

The particular features and advantages of the invention as well as other objects will become apparent from the following description taken in connection with the accompanying drawings, in which.

DETAILED DESCRIPTION

In a preferred embodiment, the image-forming device according to the present invention is supplied to an electrophotographic image-forming device. The preferred embodiment of the present invention will be described next while referring to the accompanying drawings.

1. General Structure of an Image-Forming Device

Figure 1:
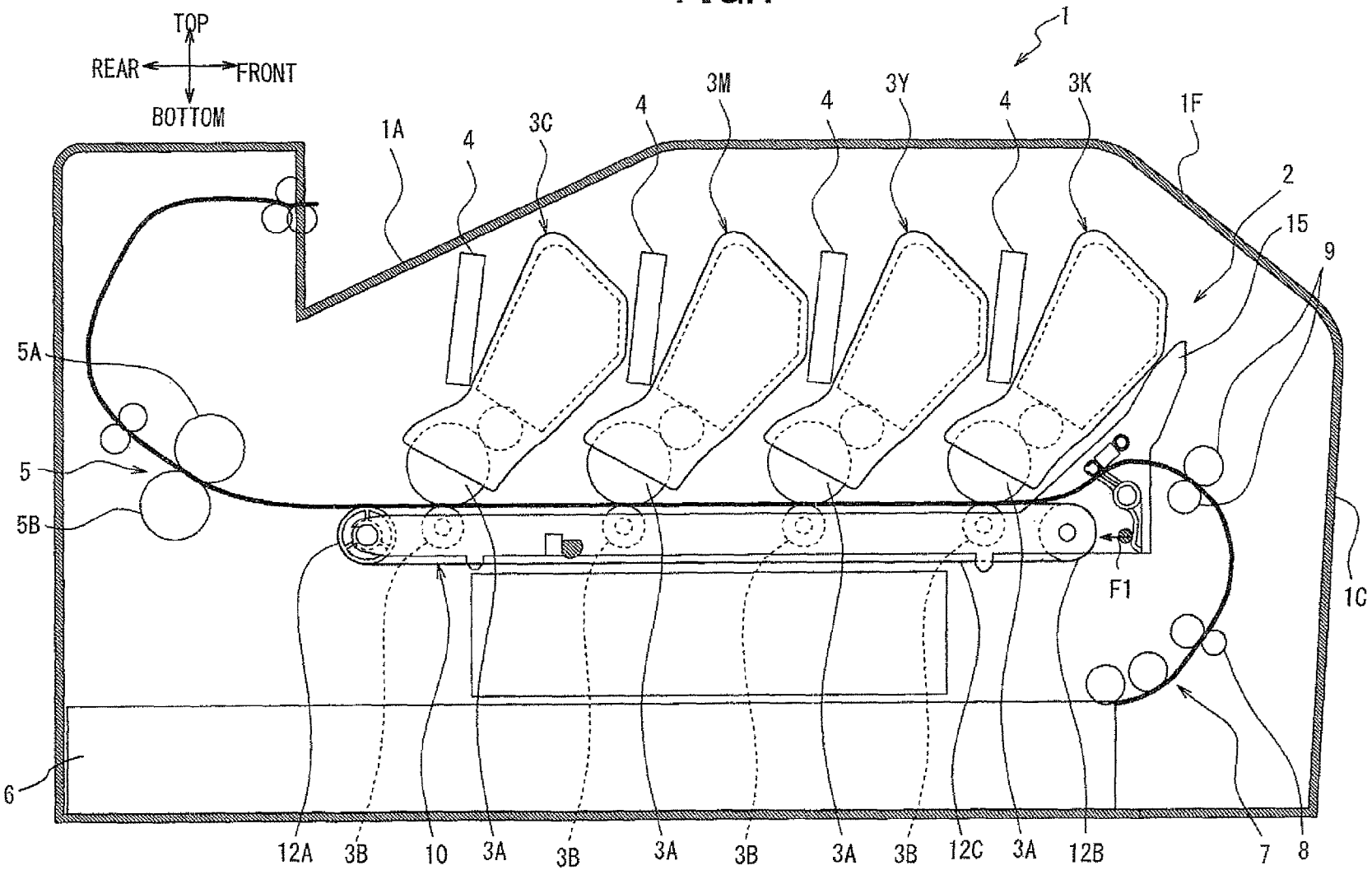
FIG. 1 is a center cross-sectional view of an image-forming device 1 according to the preferred embodiment showing the primary components thereof.

As shown in FIG. 1, an image-forming device 1 has an image-forming unit 2 for forming images on sheets of paper or transparencies (hereinafter referred to as "paper"). The image-forming unit 2 includes four process cartridges 3K, 3Y, 3M, and 3C, four corresponding exposure units 4, and a fixing unit 5.

In the preferred embodiment, a direct tandem image-forming unit 2 is employed to form color images on paper by superimposing four toner images on the paper. The four toner images are formed by the four process cartridges 3K, 3Y, 3M, and 3C corresponding to developer (toner) in the four colors black, yellow, magenta, and cyan.

The image-forming device 1 also includes a paper tray 6 accommodating a plurality of stacked sheets of paper, a feeding mechanism 7 for feeding the topmost sheet of paper on the stack, a paper dust roller 8 for removing paper dust from the sheet fed by the feeding mechanism 7 and for conveying the sheet downstream, a pair of registration rollers 9 for correcting skew in the sheet conveyed from the paper dust roller 8 and for subsequently conveying the sheet to a belt unit 10. The belt unit 10 will be described later in greater detail.

The four process cartridges 3K, 3Y, 3M, and 3C (hereinafter referred to collectively as the "process cartridges 3") are disposed above a paper-conveying surface of the belt unit 10 and arranged in the order of process cartridges 3K, 3Y, 3M, and 3C along the paper-conveying direction.

The four process cartridges 3 sequentially transfer four toner images onto a sheet of paper conveyed on the belt unit 10. After all toner images have been transferred onto the sheet, the belt unit 10 conveys the sheet to the fixing unit 5, where the toner images are fixed to the sheet by heat.

Image formation is complete when the sheet leaves the fixing unit 5. At this time, the sheet follows a U-shaped conveying path that leads upward and then forward, and the sheet is discharged onto a discharge tray 1A formed on the top surface of the image-forming device 1.

Each of the process cartridges 3 accommodates a photosensitive drum 3A for carrying a toner image, a charger (not shown) for applying a charge to the surface of the photosensitive drum 3A, and the like. After a charge has been applied to the surface of the photosensitive drum 3A, the corresponding exposure unit 4 irradiates light onto the surface to form an electrostatic latent image thereon. Subsequently, toner is supplied to the photosensitive drum 3A to develop the latent image into a toner image.

The fixing unit 5 includes a heating roller 5A that heats the toner transferred onto the paper in order to fix the toner image on the paper, and a pressure roller 5B disposed in opposition to and applying pressure to the heating roller 5A. The sheet of paper conveyed from the belt unit 10 is interposed between the heating roller 5A and pressure roller 5B.

Figure 2:
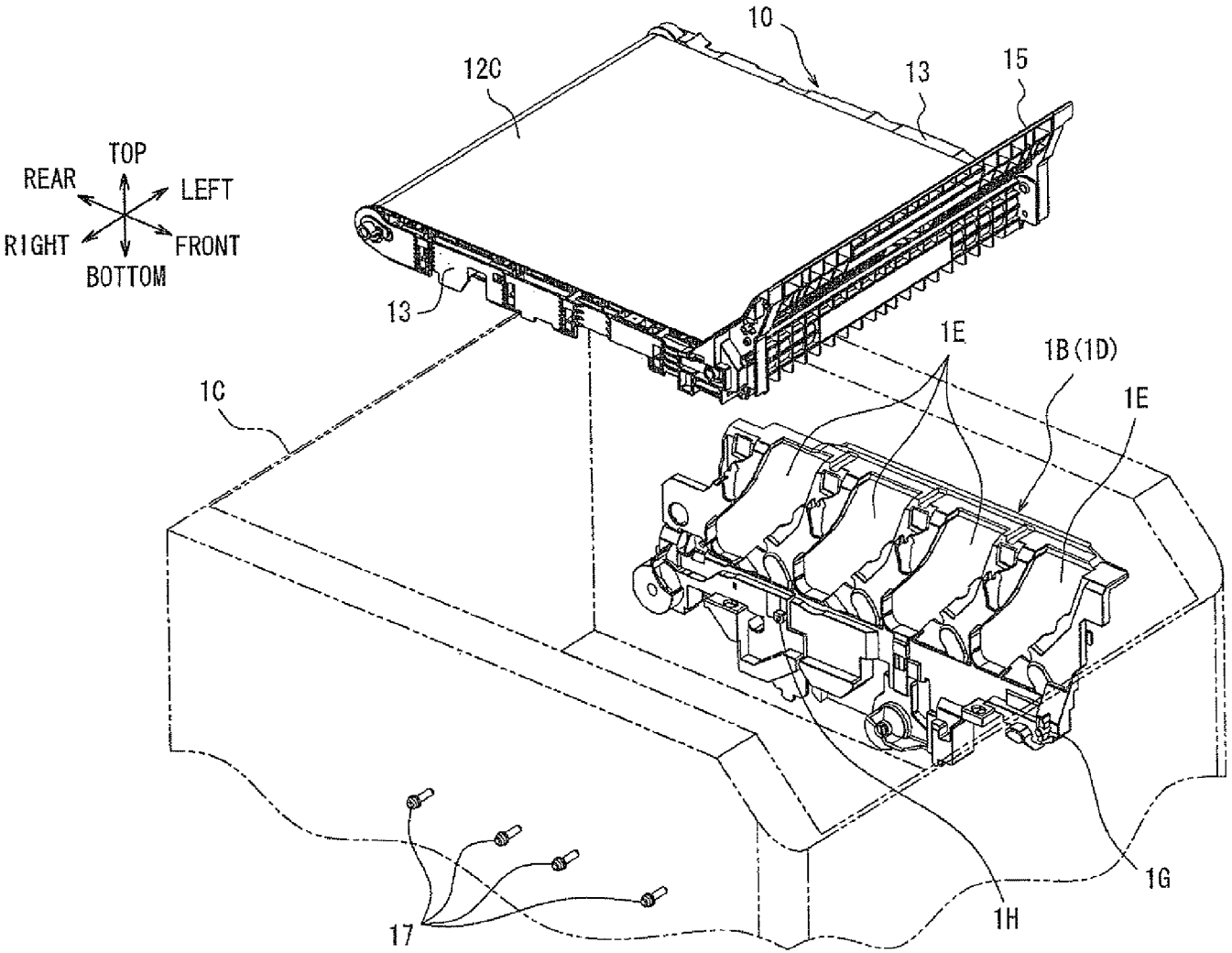
FIG. 2 is a perspective view of the image-forming device 1 when the belt unit 10 is removed from the main body frame 1B.

As shown in FIG. 2, the main body of the image-forming device 1 is partially formed by a main body frame 1B, and a casing 1C covering the main body frame 1B to form the cosmetic outer surface of the image-forming device 1. The process cartridges 3 and the belt unit 10 are detachably mounted in the main body frame 1B.

The main body frame 1B is configured of side frame parts 1D provided on both sides of the image-forming device 1 in the width direction (i.e., the left and right sides), connecting frame parts (not shown) for joining the side frame parts 1D, and the like. Only one of the side frame parts 1D (the left side frame part 1D) is shown in FIG. 2, while the other side frame part 1D and the connecting frame parts are not shown.

Four grooves 1E are formed in each of the two side frame parts 1D for retaining the four process cartridges 3 and for guiding each of the process cartridges 3 to a prescribed position when the process cartridges 3 are mounted in the main body frame 1B (image-forming device 1). The grooves 1E are sloped relative to the vertical.

Figure 3:
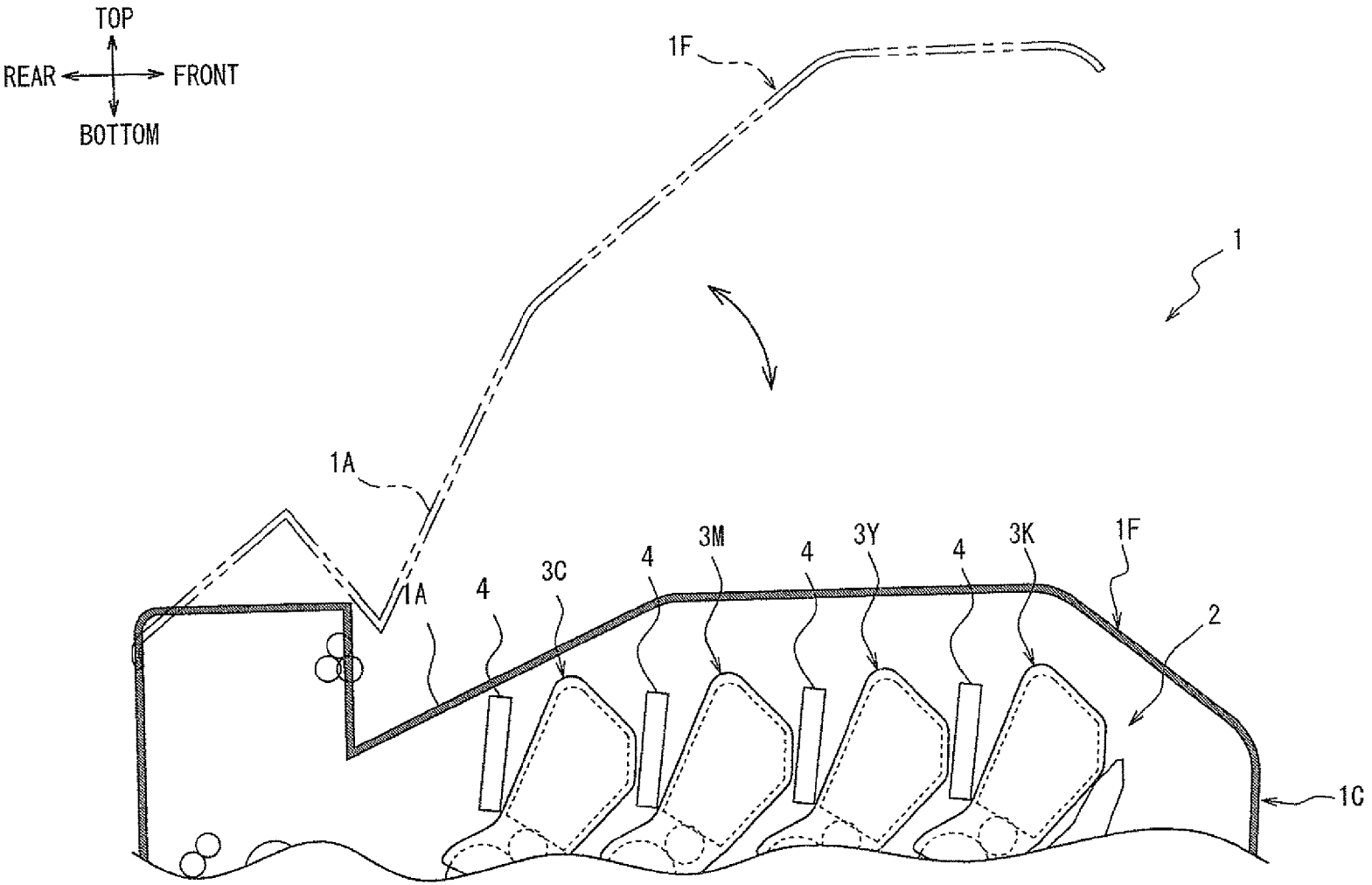
FIG. 3 is a center cross-sectional view of the image-forming device 1 when a top cover 1F is in an open state.

The casing 1C includes a top cover 1F on which the discharge tray 1A is provided. As shown in FIG. 3, the top cover 1F is pivotably assembled on the casing 1C. By rotating the top cover 1F upward, the space above the four process cartridges 3 is exposed.

Hence, the process cartridges 3 are mounted in and removed from the main body frame 1B of the image-forming device 1 by rotating the top cover 1F upward to expose the process cartridges 3 in the top of the image-forming device 1 and then inserting or removing the process cartridges 3 in a direction sloping from the top front to the bottom rear of the image-forming device 1.

Figure 11:
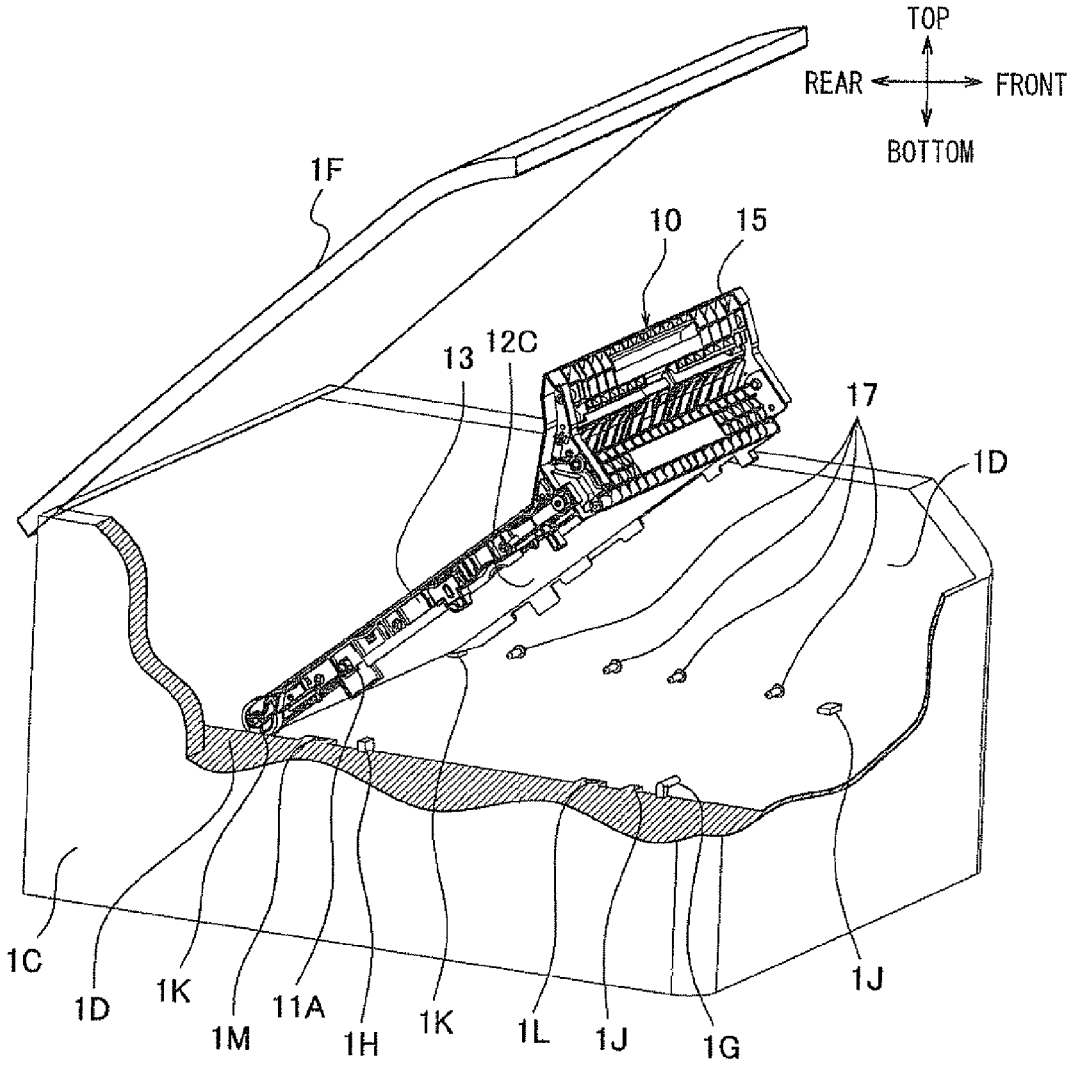
FIG. 11 is a perspective view of the image-forming device 1 while the belt unit 10 is in the process of being removed.

In order to remove the belt unit 10 from the main body frame 1B, the operator first opens the top cover 1F and removes the four process cartridges 3 from the main body frame 1B. Subsequently, the operator grips a handle part 15 described later and pulls upward, as illustrated in FIG. 11.

2. Structure of the Belt Unit 2.1 Basic Structure of the Belt Unit

As described above, the belt unit 10 according to the preferred embodiment is disposed in a position confronting each photosensitive drum 3A in the four process cartridges 3. The belt unit 10 functions to convey sheets of paper.

As shown in FIG. 1, the belt unit 10 more specifically includes a belt unit main frame (not shown), a drive roller 12A and a follow roller (tension roller) 12B having rotational axes parallel to the rotational axes of the photosensitive drums 3A, a conveying belt 12C mounted around the rollers 12A and 12B, and a transfer rollers 3B for transferring toner images carried on the photosensitive drums 3A to the sheet of paper. Sheets of paper are conveyed while resting on top of the conveying belt 12C.

The belt unit main frame has a rectangular shape defined by a first main end portion and a second main end portion in a front-to-rear direction and a third main end portion and a fourth main end portion in a right-to-left direction. The drive roller 12A is disposed at the first main end portion, and the follow roller 12B is disposed at the second main end portion. The distance between the first main end portion and the second main end portion may be shorter than the length of the third main end portion and the fourth main end portion in the front-to-rear direction. Further, the distance between the first main end portion and the second main end portion may be substantially equal to the length of the third main end portion and the fourth main end portion in the front-to-rear direction.

The drive roller 12A receives a drive force from a motor (not shown) mounted on the main body of the image-forming device 1 (the main body frame 1B) and drives the conveying belt 12C to circulate. The follow roller 12B rotates along with the rotation of the drive roller 12A and the circulation of the conveying belt 12C.

Figure 4:
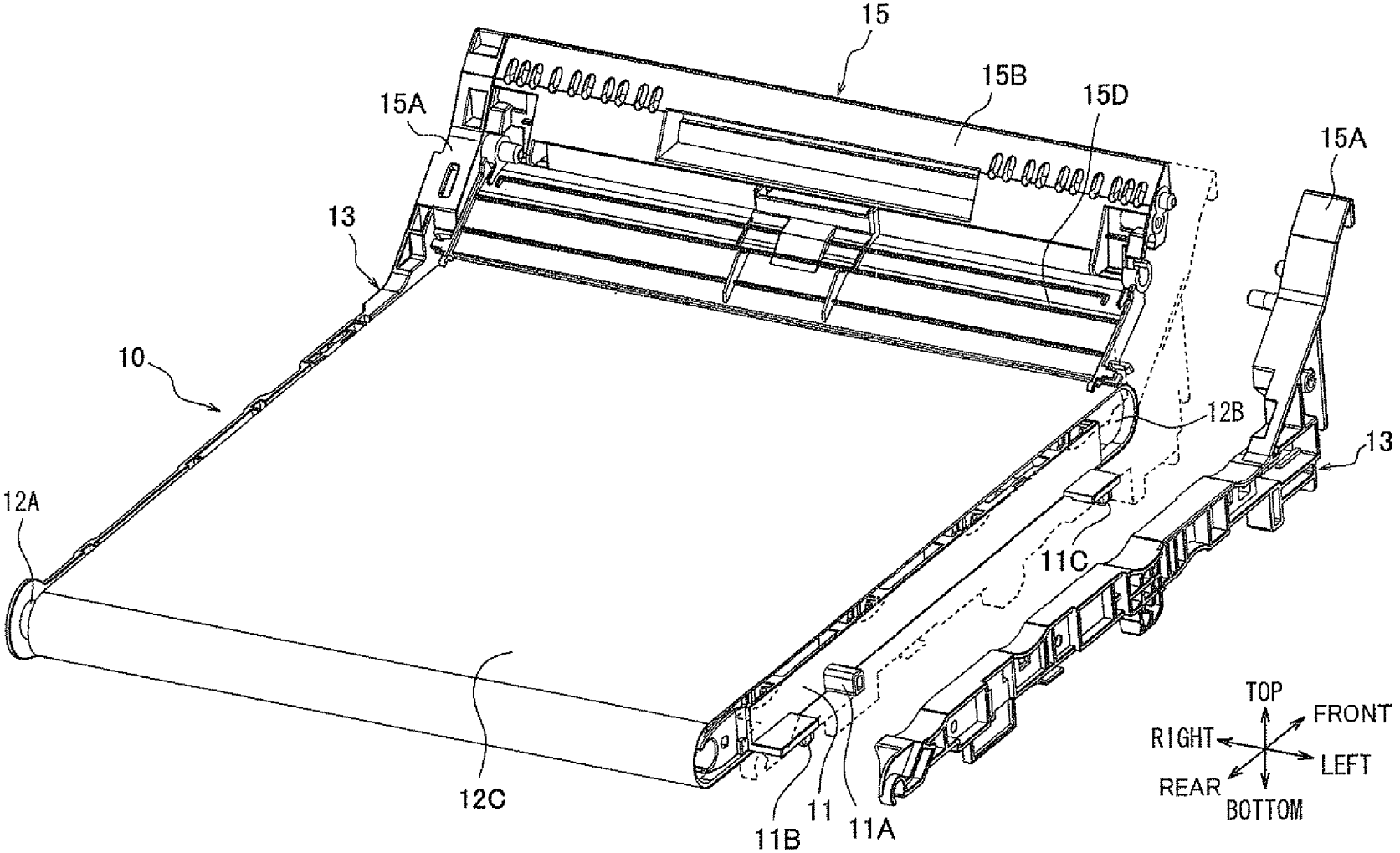
FIG. 4 is a perspective view of the belt unit 10 when one belt unit side frame 13 (the side frame on the left side in a width direction) has been removed from the belt unit 10.
Figure 10:
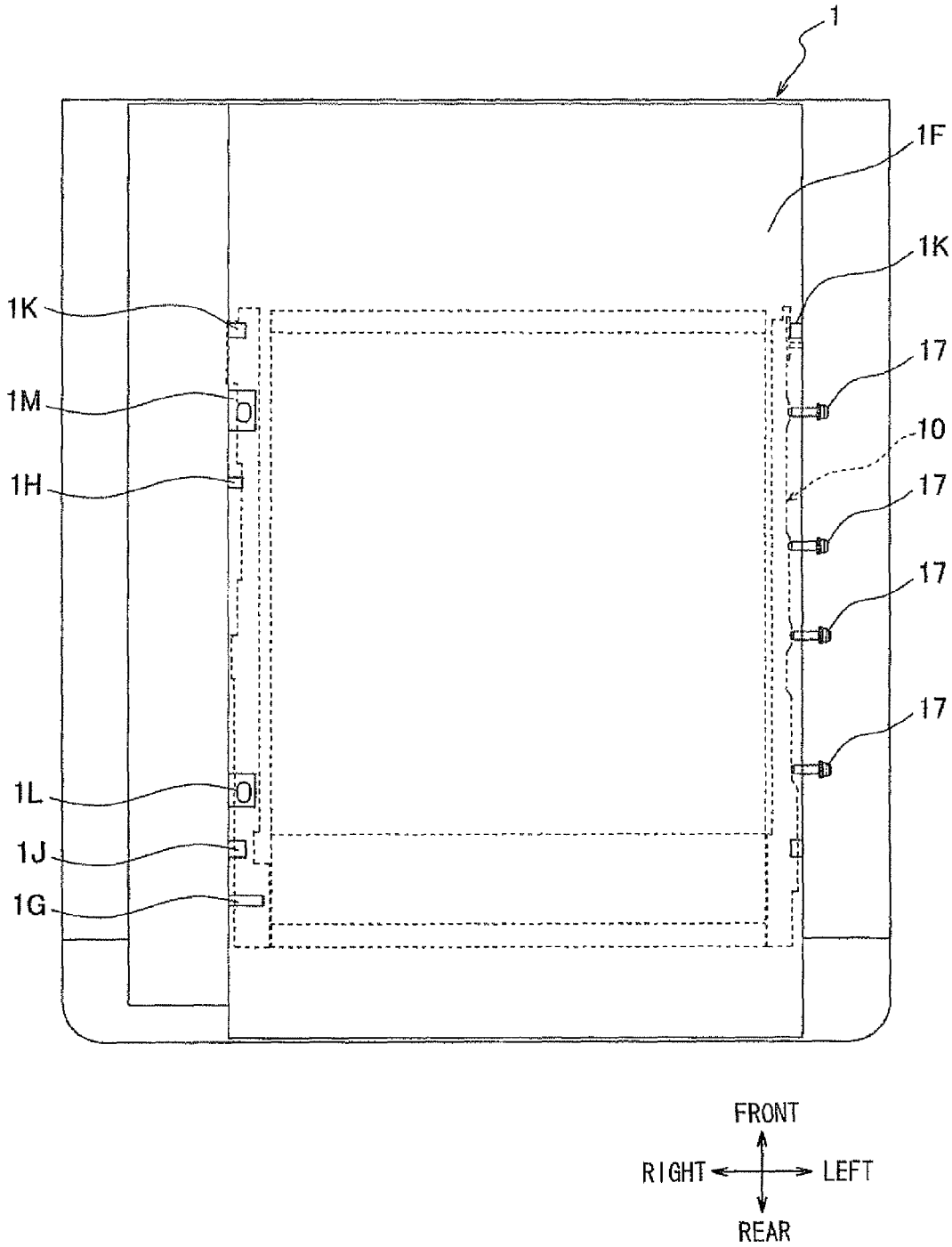
FIG. 10 is a plan view of the image-forming device 1 showing a belt unit 10 mounted in a main body frame 1B of the image-forming device 1.

As shown in FIG. 10, the drive roller 12A is rotatably assembled on one end of a belt unit main frame 11 (the rear end in FIG. 4). The follow roller 12B is rotatably and displaceably assembled on the other end of the belt unit main frame 11 (the front end in FIG. 4), so that the axis of the follow roller 12B is parallel to the axis of the drive roller 12A.

As shown in FIG. 4, a belt unit side frame 13 is provided on both left and right sides of the belt unit main frame 11, i.e., on both sides of the belt unit main frame 11 relative to the axial direction of the drive roller 12A (hereinafter referred to as the "width direction"). The belt unit side frames 13 extend in the front to rear direction, which is also the direction that the conveying belt 12C is stretched from the drive roller 12A to the follow roller 12B.

Hence, the drive roller 12A drives the conveying belt 12C to circulate by rotating without the position of the drive roller 12A relative to the belt unit side frame 13 changing in the front-to-rear direction.

Figure 5:
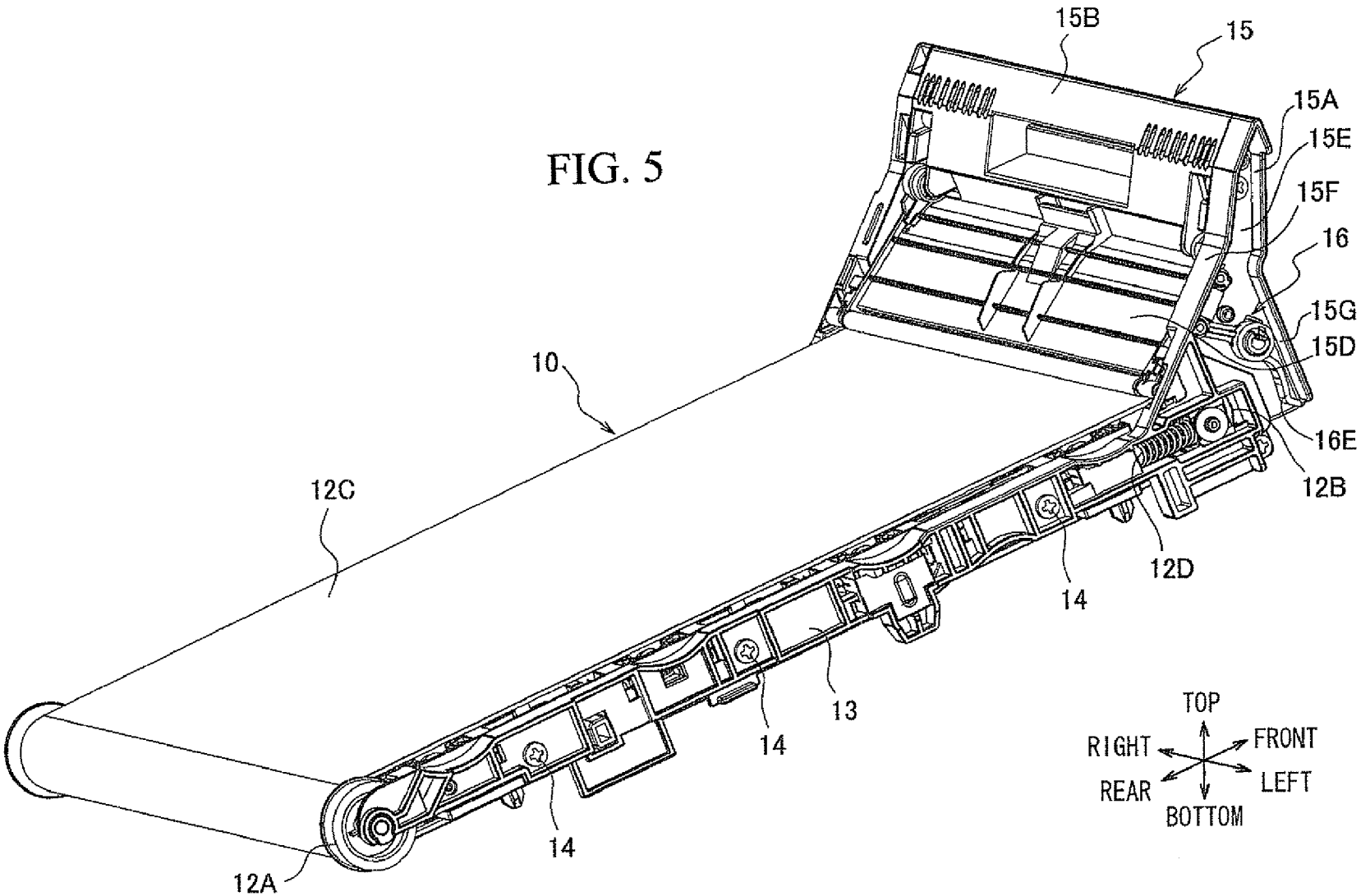
FIG. 5 is a perspective view of the belt unit 10.

On the other hand, a coil spring 12D provided in each belt unit side frame 13 applies a force to the follow roller 12B for urging the follow roller 12B away from the drive roller 12A, as shown in FIG. 5: The coil springs 12D and the follow roller 12B apply a prescribed tension to the conveying belt 12C when the follow roller 12B is displaced forward.

The belt unit side frames 13 are detachably fixed to the belt unit main frame 11 by screws 14 or other mechanical fasteners. The handle part 15 is provided on the follow roller 12B side of the belt unit 10. The user or service technician grips the handle part 15 when mounting or removing the belt unit 10.

Figure 6A:
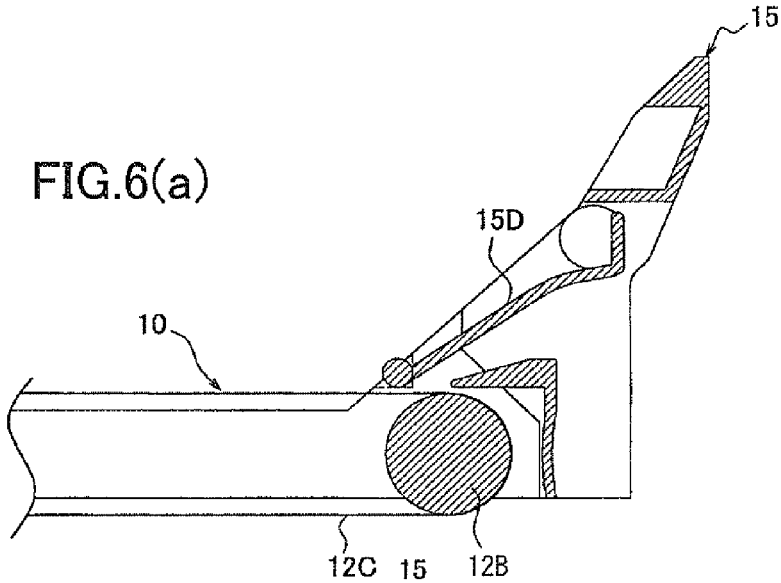
FIGS. 6(*a*)-6(*c*) are explanatory diagrams illustrating the operation of a chute 15D provided in the belt unit 10.
Figure 6B:
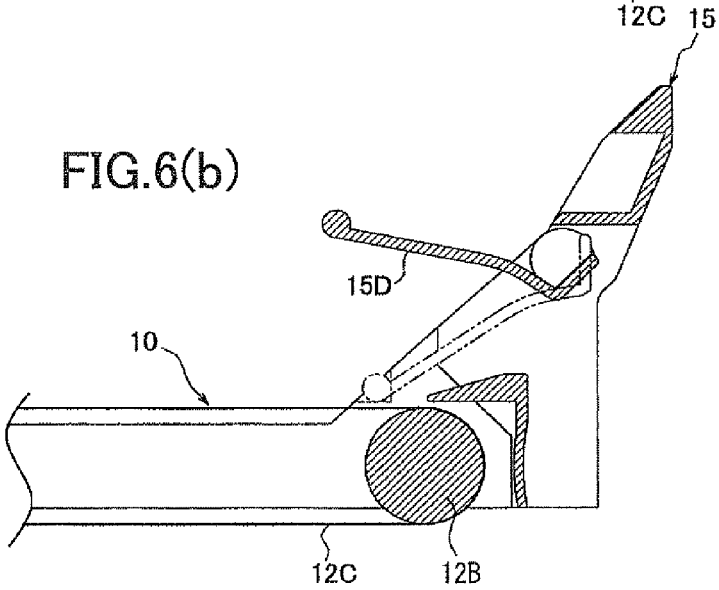
Figure 6C:
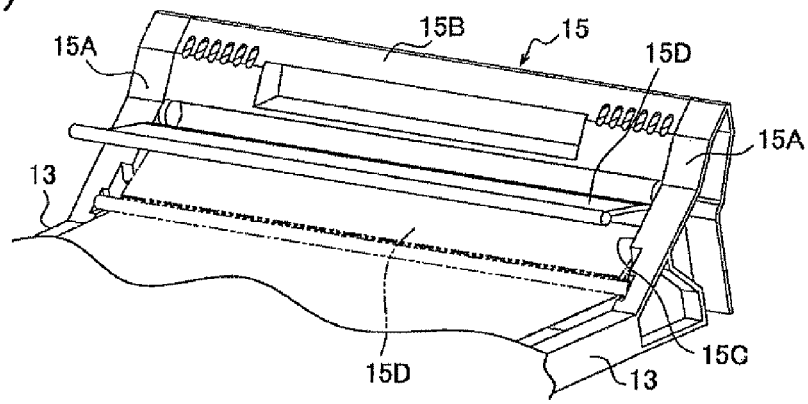

As shown in FIGS. 4 and 5, the handle part 15 includes a handle side frame 15A provided on one longitudinal end of each belt unit side frame 13, a bridge part 15B extending in the width direction (left-to-right direction) in order to bridge the handle side frames 15A, and a plate-shaped chute 15D that fills an opening 15C (see FIG. 6(*c*)) formed between the handle side frames 15A and the bridge part 15B.

As shown in FIGS. 6(*a*)-6(*c*), the edge of the chute 15D nearest the bridge part 15B is attached to the handle side frames 15A so that the chute 15D may pivot. The chute 15D functions to guide a sheet of paper conveyed by the feeding mechanism 7 toward the conveying belt 12C.

As shown in FIG. 5, each handle side frame 15A has a plate-shaped frame wall 15E oriented orthogonal to a plane occupied by the conveying belt 12C and parallel to the corresponding belt unit side frame 13; and a first rib 15F and a second rib 15G protruding in the width direction substantially orthogonal to the frame wall 15E. The handle side frame 15A is open on the bottom side, i.e., the side corresponding to the distal end of a second arm 16E (a first contacted part 16B) described later. That is, no ribs or wall parts are provided on the bottom of the handle side frame 15A.

The top surface of the conveying belt 12C is stretched flat between the follow roller 12B and drive roller 12A. In the preferred embodiment, the top surface of the conveying belt 12C is substantially a horizontal plane that supports and conveys sheets of paper.

The frame wall 15E occupies a plane following one widthwise edge of the belt unit side frame 13 that is closed to the follow roller 12B side, and specifically a first plane S1 (see FIG. 7) that passes through a widthwise edge of the conveying belt 12C and is substantially orthogonal to the plane occupied by the conveying belt 12C.

The distal end of the protruding first rib 15F is substantially positioned in a plane passing through the other widthwise edge of the belt unit side frame 13 that is far from the follow roller 12B, and more specifically a second plane S2 (see FIG. 7) parallel to the first plane S1 and including the entire widthwise edge of the belt unit 10.

Figure 8:
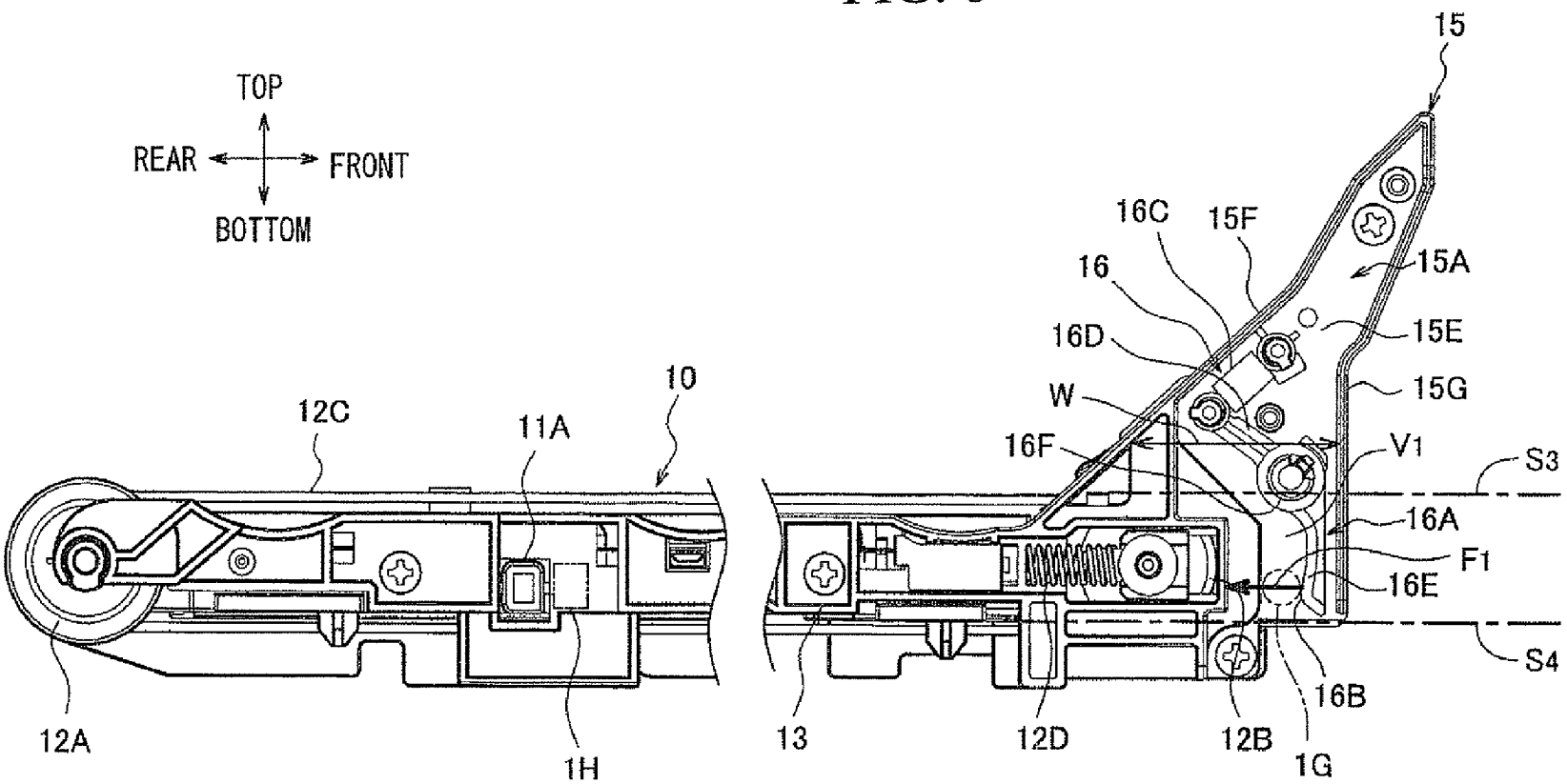
FIG. 8 is a left side view of the belt unit 10 shown in FIG. 7.
Figure 9:
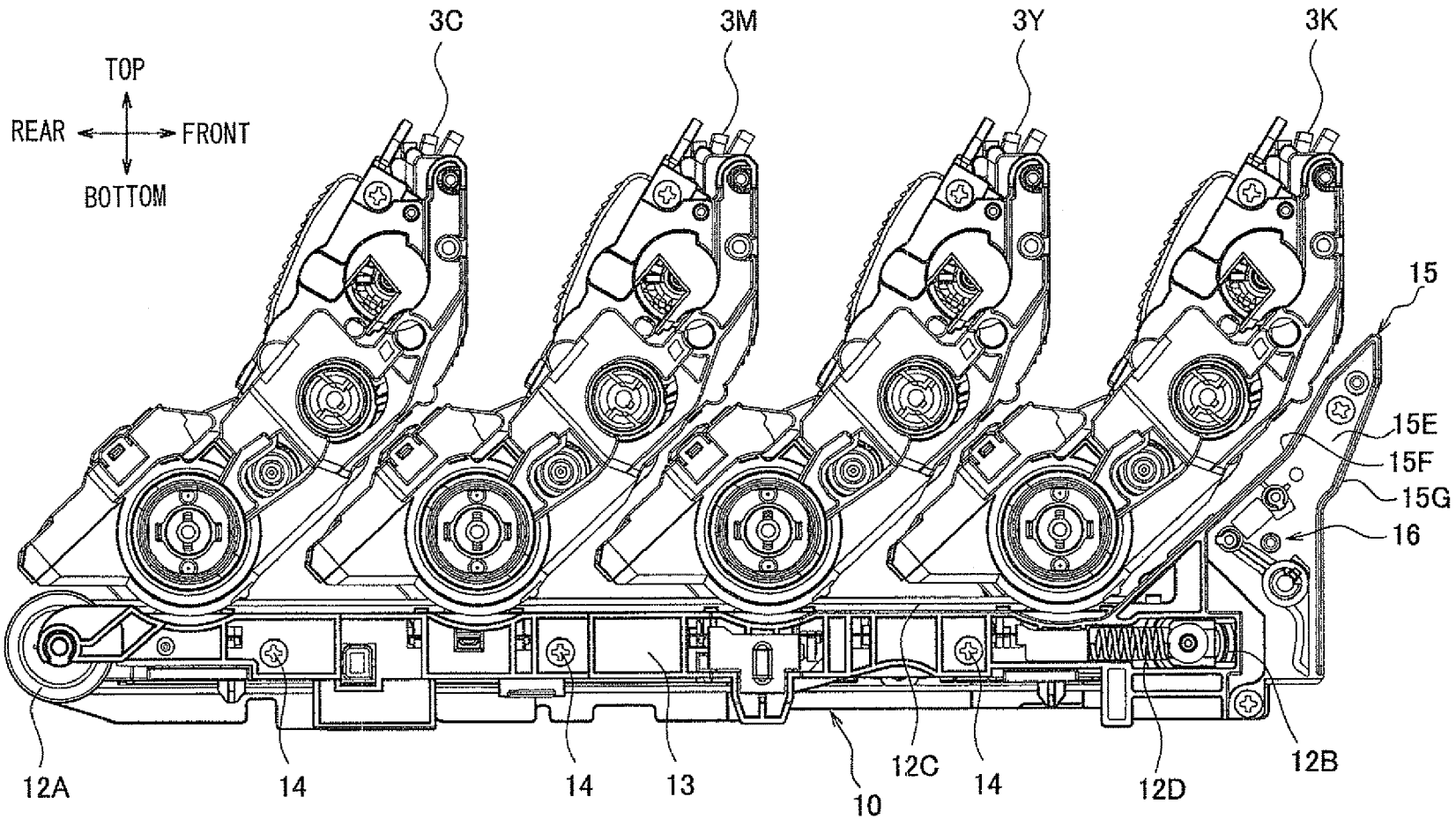
FIG. 9 is a side view showing the positional relationships of process cartridges 3 and the belt unit 10.

As shown in FIG. 8, the frame wall 15E has a triangular shape, with a dimension W in the front-to-rear direction that expands from the upper end near the distal end (bridge part 15B) of the handle part 15 toward the follow roller 12B. As shown in FIG. 9, the edge of the frame wall 15E on the process cartridge 3K side slopes in a direction substantially parallel to the slope of the process cartridge 3K.

The first rib 15F is provided on the edge of the frame wall 15E nearest the drive roller 12A (the process cartridge 3K side). The second rib 15G, on the other hand, is provided on the other edge of the frame wall 15E opposite the first rib 15F (the front side of the image-forming device 1).

The protruding length of the second rib 15G is set smaller than the protruding length of the first rib 15F (excluding the area next to the bridge part 15B (see FIG. 5)), where the protruding lengths of the first rib 15F and second rib 15G are the distances from the frame wall 15E to the distal edges thereof in the width direction.

2.2 Structure of Holding Mechanisms and the Like

Holding mechanisms 16 are provided on the belt unit side frame 13 side of the handle part 15, i.e., the frame walls 15E, as shown in FIG. 8. The holding-mechanisms 16 function to hold the belt unit 10 in a position relative to the main body frame 1B when the belt unit 10 is mounted in the image-forming device 1.

Each holding mechanism 16 includes a lever member 16A, a first contacted part 16B provided on the lever member 16A for contacting a first contacting part 1G (FIGS. 10 and 11) provided on the main body frame 1B, and a coil spring 16C for applying an elastic force to the lever member 16A in a direction aimed at increasing the force of contact between the first contacting part 1G and first contacted part 16B. The first contacting part 1G of the main body frame 1B is sandwiched between the first contacted part 16B and the front end of the belt unit side frame 13, when the belt unit 10 is mounted in the image-forming device 1.

As shown in FIGS. 10 and 11, the first contacting part 1G is a protruding part that protrudes from the side frame part 1D toward the belt unit 10.

As shown in FIG. 8, the lever member 16A is rotatably mounted on the frame wall 15E through a curved part 16F. The lever member 16A is bent at an angle, with the sides of the angle formed by a first arm 16D coupled to one axial end of the spring 16C for receiving the elastic force applied by the spring 16C, and the second arm 16E on the distal end of which the first contacted part 16B is provided.

Figure 7:
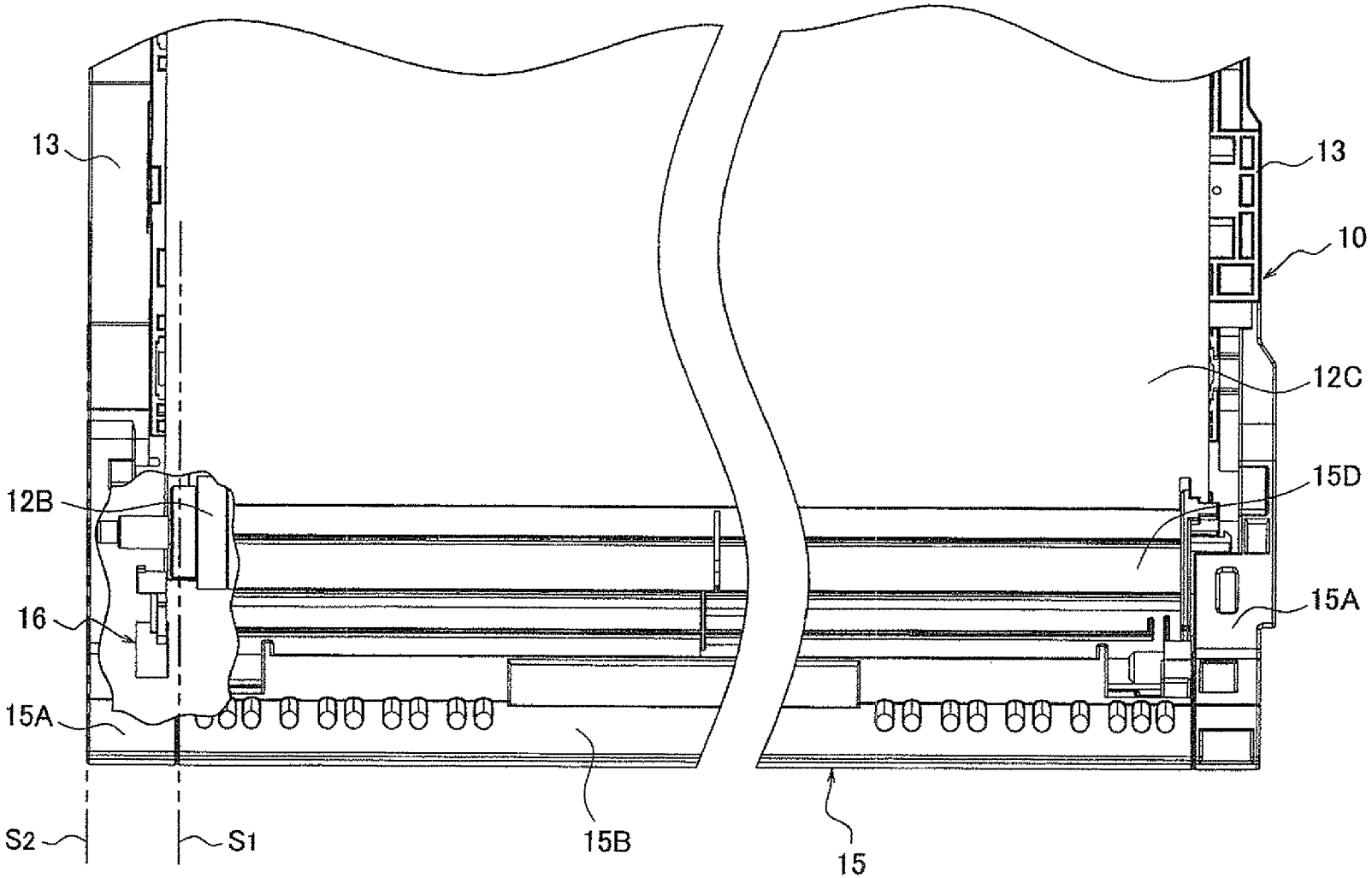
FIG. 7 is a plan view of the belt unit 10 near a handle part 15.

As shown in FIG. 7, the lever member 16A and spring 16C (i.e., the holding mechanism 16) are accommodated between the first plane S1 and second plane S2. As shown in FIG. 8, if the belt unit side frame 13 were extended farther on the handle part 15 side, the first contacted part 16B would be disposed in a region V1 in which the virtual extension of the belt unit side frame 13 falls.

In other words, the first contacted part 16B is disposed in a space on the other side of the follow roller 12B from the drive roller 12A defined by the first plane S1 and second plane S2, a third plane S3 passing through the upper edge of the belt unit side frame 13, and a fourth plane S4 passing through the bottom edge of the belt unit side frame 13.

In the preferred embodiment, the vertical direction is aligned with a direction orthogonal to both the longitudinal dimension and width dimension of the belt unit side frame 13.

Further, when the belt unit 10 is mounted in the main body frame 1B, the lever member 16A and spring 16C are set such that the longitudinal direction of the first arm 16D is substantially orthogonal to the axial direction of the spring 16C and the longitudinal direction of the second arm 16E is substantially orthogonal to the plane to which the conveying belt 12C belongs (the longitudinal dimension of the belt unit side frame 13).

More specifically, the spring 16C is arranged so that the strip-like first rib 15F extending continuously from the top end of the handle part 15 (the bridge part 15B) is substantially parallel to the axis of the spring 16C. The lever member 16A is oriented so that the longitudinal dimension of the first arm 16D is substantially orthogonal to the extended direction of the first rib 15F and the longitudinal dimension of the second arm 16E is substantially orthogonal to the front-to-rear dimension of the image-forming device 1.

As shown in FIGS. 10 and 11, a second contacting part 1H is provided on the main body frame 1B (side frame part 1D) in a location opposite the belt unit side frame 13 and closer, to the drive roller 12A than the first contacting part 1G.

While the casing 1C and the main body frame 1B (side frame parts 1D) are shown as a single unit in FIG. 11, as described above, the casing 1C covers the main body frame 1B in the preferred embodiment. Thus, the main body frame 1B and the casing 1C are separate elements.

A second contacted part 11A is provided on one widthwise side of the belt unit 10 (the belt unit side frame 13) in a location closer to the drive roller 12A than a center position between the drive roller 12A and follow roller 12B. The second contacted part 11A contacts the second contacting part 1H when the belt unit 10 is mounted in the main body frame 1B.

As shown in FIG. 4, the second contacted part 11A is provided on the belt unit main frame 11 of the belt unit 10 in the preferred embodiment. The second contacted part 11A penetrates the belt unit side frame 13 in the width direction so as to be exposed on the widthwise side of the belt unit 10.

As shown in FIG. 8, the first contacted part 16B of the lever member 16A contacts the first contacting part 1G from the second rib 15G side and applies to the first contacting part 1G a force F1 acting toward the drive roller 12A. Hence, a reaction force to the force F1 applied by the lever member 16A to the first contacting part 1G acts to move the belt unit 10 toward the follow roller 12B side from the drive roller 12A side.

However, since the second contacted part 11A contacts the second contacting part 1H from the drive roller 12A side, the belt unit 10 is restricted from moving toward the follow roller 12B side despite the reaction force acting on the belt unit 10. Further, the contact pressure between the second contacting part 1H and the second contacted part 11A increases, ensuring that the position of the belt unit 10 in the front-to-rear direction is securely held.

As shown in FIGS. 10 and 11, reference surfaces 1J and 1K are provided on the main body frame 1B for supporting the belt unit 10. The reference surfaces 1J contact the bottom edge of the belt unit side frames 13 on the follow roller 12B side, while the reference surfaces 1K receive the axial ends of the drive roller 12A.

The first contacting part 1G and second contacting part. 1H are provided only on one of the side frame parts 1D. This same side frame part 1D is also provided with widthwise positioning parts 1L and 1M for setting the position of the belt unit 10 relative to the main body frame 1B in the width direction.

The widthwise positioning parts 1L and 1M each have an engaging hole formed therein. As shown in FIG. 4, protruding parts 11B and 11C are provided on the belt unit main frame 11 of the belt unit 10 to be inserted into the engaging holes formed in the widthwise positioning parts 1L and 1M. The protruding part 11B is inserted and engaged in the engaging hole formed in the widthwise positioning part 1M, and the protruding part 11C is inserted and engaged in the engaging hole formed in the widthwise positioning part 1L.

Electrode parts 17 are provided on the side frame part 1D opposite the side frame part 1D on which the first contacting part 1G and the like are provided. The electrode parts 17 supply power to the transfer rollers 3B when transferring toner images carried on the photosensitive drums 3A to the sheet of paper.

3. Features of the Image-Forming Device According to the Preferred Embodiment

In the preferred embodiment, the handle part 15 is provided on the follow roller 12B side of the belt unit 10, the first contacted parts 16B are provided on the belt unit side frame 13 side of the handle part 15, and the second contacted part 11A is provided on the drive roller 12A side of the belt unit 10. Accordingly, the belt unit 10 can be detachably mounted in the main body frame 1B according to a novel construction that differs from the invention disclosed in Japanese unexamined patent application publication No. 2007-101728 mentioned in the related art.

Further, the first contacted part 16B is positioned closer to the follow roller 12B than the second plane S2 in the preferred embodiment. This configuration prevents the first contacted part 16B and lever member 16A from interfering with the side frame part 1D and the like when mounting and removing the belt unit 10.

In the preferred embodiment, the first contacted part 16B is positioned within a region V1 that would be occupied by the belt unit side frame 13 if the belt unit side frame 13 were extended farther toward the handle part 15. Accordingly, a force F1 acting in a direction substantially equivalent to the longitudinal dimension of the belt unit side frame 13 can be applied to the belt unit side frame 13 to reliably maintain the position of the belt unit 10.

In the preferred embodiment described above, the first and second ribs 15F and 15G are provided on the frame wall 15E, which is the side of the handle part 15 in which the first contacted part 16B is provided, and protrude out from the frame wall 15E in the width direction. This configuration improves the mechanical strength of the handle side frame 15A.

In the present embodiment, the follow roller 12B is movable in the front-to-rear direction, since the follow roller 12B is inserted in an elliptic hole formed (not shown) in the belt unit side frame 13 and is biased by a spring (not shown) in the front-to-rear direction. On the other hand, the drive roller 12A is capable of rotating but not being displaced relative to the belt unit side frame 13. Thus, the drive roller 12A must be positioned with greater accuracy than the follow roller 12B.

However, the belt unit side frame 13 is formed of a synthetic resin in the preferred embodiment, which has a relatively high rate of expansion and contraction caused by changes in temperature. Therefore, the position of the drive roller 12A could change greatly due to changes in temperature.

To resolve this problem, the second contacted part 11A in the preferred embodiment is disposed between the follow roller 12B and drive roller 12A and closer to the drive roller 12A, thereby reducing the distance between the second contacted part 11A and the drive roller 12A.

Hence, even if the belt unit side frame 13 expands and contracts due to changes in temperature, the distance between the drive roller 12A and second contacted part 11A does not greatly expand and contract. Accordingly, this construction reduces the effects of temperature so that the drive roller 12A is positioned with greater accuracy.

Further, providing the second contacted part 11A on the belt unit main frame 11 in the preferred embodiment achieves greater positioning accuracy of the second contacted part 11A than when providing the second contacted part 11A on the belt unit side frame 13, thereby positioning the drive roller 12A with greater accuracy.

In the preferred embodiment, the holding mechanism 16 is disposed on the handle side frame 15A and accommodated between the first plane S1 and second plane S2. This construction allows the image-forming device 1 to be made more compact than when a function corresponding to that of the holding mechanism 16 is provided on the main body (side frame parts 1D) of the image-forming device 1.

Further, the spring 16C is oriented so that its axis is parallel to a direction extending from the follow roller 12B side to the top of the handle part 15. Therefore, even a holding mechanism 16 having a large dimension in the axial direction can be accommodated in the space between the first plane S1 and second plane S2, allowing the image-forming device 1 to be made more compact.

Further, the description of the spring 16C being "oriented so that its axis is parallel to a direction extending from the follow roller 12B side to the top of the handle part 15" is not confined to the strict definition of "parallel," but includes the meaning of substantially parallel to the naked eye.

When the belt unit 10 is mounted in the main body frame 1B (side frame parts 1D) in the preferred embodiment, the longitudinal dimension of the first arm 16D is orthogonal to the axis of the spring 16C and the longitudinal dimension of the second arm 16E is orthogonal to the plane occupied by the conveying belt 12C. Accordingly, the spring 16C can efficiently apply the force F1 to the first contacting part 1G.

Here, "orthogonal" is not limited to the strict definition of the word orthogonal, but includes the meaning substantially orthogonal to the naked eye.

In the preferred embodiment, the frame wall 15E has a substantially triangular shape with a dimension W in the front-to-rear direction that grows larger from the top of the handle part 15 toward the follow roller 12B. This construction increases the strength of the handle part 15 (handle side frame 15A), while effectively allocating space for accommodating the holding mechanism 16.

4. Variations of the Embodiment

Although the present invention has been described with respect to specific embodiments, it will be appreciated by one skilled in the art that a variety of changes may be made without departing from the scope of the invention.

The preferred embodiment describes a direct tandem image-forming device that directly transfers toner images carried on the photosensitive-drums 3A to a sheet of paper. However, the present invention may also be applied to an image-forming device that first transfers the toner images carried on the photosensitive drums 3A to an intermediate transfer belt and subsequently transfers the toner images from the intermediate transfer belt to the sheet of paper.

Further, while the present invention is applied to a color image-forming device in the preferred embodiment described above, the present invention may be applied to a monochrome image-forming device or the like and is not limited to a color image-forming device.

Further, while the exposure unit employs LEDs in the preferred embodiment, the exposure unit may be configured to scan a laser beam and is not limited to the exposure unit described in the preferred embodiment.

While the spring 16C of the holding mechanism 16 is described as a coil spring in the preferred embodiment described above, the spring 16C may be configured of a torsion spring, a leaf spring, or another type of spring.

In the preferred embodiment described above, the bridge part 15B side of the chute 15D is pivotably attached to the handle side frame 15A, but the other side of the chute 15D may be fixed to the handle side frame 15A.

The belt unit main frame 11 and belt unit side frames 13 in the preferred embodiment are molded separately and subsequently fixed together with screws, but the belt unit main frame 11 and belt unit side frames 13 may be molded as a single integral unit instead.

In the preferred embodiment described above, the conveying belt 12C is mounted around two rollers including the drive roller 12A and follow roller 12B, but the conveying belt 12C may be mounted around three or more rollers instead.

What is claimed is:

1. An image-forming device comprising:

a body frame having a first contacting part and a second contacting part; and a belt unit detachably mounted in the body frame comprising:

a belt unit main frame having a first main end portion and a second main end portion in a first direction and a third main end portion and a fourth main end portion in a second direction orthogonal to the first direction;

a first roller disposed at the first main end portion;

a second roller disposed at the second main end portion;

a belt mounted around the first roller and the second roller;

a belt unit side frame attached to at least one of the third main end portion and the fourth main end portion;

a handle part disposed at the first main end portion;

a first contacted part provided on the handle part to contact the first contacting part; and a second contacted part provided on one of the belt unit main frame and the belt unit side frame to contact the second contacting part, the second contacted part being closer to the second roller than the first roller, wherein the belt unit side frame has a first side end portion and a second side end portion in the second direction, the first side end portion being attached to the at least one of the third main end portion and the fourth main end portion, wherein the first contacted part is disposed between a first plane passing thorough the first side end portion and a second plane passing through the second side end portion, the first plane and the second plane being provided at the same side of the belt unit in the second direction and extending in parallel in a direction orthogonal to the belt surface, wherein the belt unit side frame has a height orthogonal to both the first direction and the second direction, and wherein the handle part has space therein, the first contacted part being disposed within the height in the space.

2. The image-forming device according to claim 1, wherein the second contacting part is opposed to the belt unit side frame.

3. The image-forming device according to claim 1, wherein the handle part has a surface orthogonal to the second direction on which the first contacted part is provided and having an edge, and a wall extending in the second direction and covering at least one part of the edge.

4. The image-forming device according to claim 1, wherein the body frame has a first positioning part, and the belt unit has a second positioning part engaged with the first positioning part to position the belt unit for the body frame in the second direction, and wherein the first contacting part, the second contacting part, and the first positioning part are disposed at only one end of the body frame, and the first contacted part, the second contacted part, and the second positioning part are disposed at only one end of the belt unit.

5. The image-forming device according to claim 1, the belt unit side frame is separable from the belt unit main frame, the second contacted part being provided on the belt unit main frame.

6. The image-forming device according to claim 1, wherein the belt unit further comprises a holding unit provided in the handle part to hold a position of the belt unit for the body frame.

7. The image-forming device according to claim 6, wherein the holding unit is provided at a belt unit frame side of the handle part.

8. The image-forming device according to claim 6, wherein the holding unit increases a contact pressure between the second contacting part and the second contacted part in the first direction.

9. The image-forming device according to claim 8, wherein the second roller provides the belt with a driving force to rotate the belt, and the first roller rotates in accordance with the rotation of the belt, and wherein the first roller is movable in the first direction, and the second roller is not movable in the first direction, the second contacted part being closer to the second roller than a center point of the first roller and the second roller.

10. The image-forming device according to claim 8, wherein the holding unit comprises:

a lever member on which the first contacted part is provided; and an elastic member providing the lever member with a force to increase the contact pressure between the second contacting part and the second contacted part.

11. The image-forming device according to claim 10, wherein the handle part having a top end and a side end at the belt unit side frame, wherein the elastic member is a coil spring having an axis extending in a direction-parallel to a line connecting the top end with the side end.

12. The image-forming device according to claim 11, wherein the lever member has a first arm receiving the force from the elastic member, a second arm on which the first contacted part is provided, and a curved part connecting the first arm with the second arm at an angle, wherein in a state where the belt unit is mounted in the frame, a direction in which the first arm extends is orthogonal to a direction in which the axis extends and a direction in which the second arm extends is orthogonal to the first direction.

13. The image-forming device according to claim 6, wherein the handle part has a surface orthogonal to the second direction on which the first contacted part is provided and having an edge, and a wall extending in the second direction and covering at least one part of the edge, and wherein the wall has a triangle-shaped cross section in the second direction that expands toward the belt unit main frame, the holding unit being accommodated in the triangle-shaped cross section via the virtual side.

14. An image-forming device comprising:

a body frame having a first contacting part and a second contacting part; and a belt unit detachably mounted in the body frame comprising:

a belt unit main frame having a first main end portion and a second main end portion in a first direction and a third main end portion and a fourth main end portion in a second direction orthogonal to the first direction;

a first roller disposed at the first main end portion;

a second roller disposed at the second main end portion;

a belt mounted around the first roller and the second roller;

a belt unit side frame attached to at least one of the third main end portion and the fourth main end portion;

a handle part disposed at the first main end portion; and a holding unit provided in the handle part to hold a position of the belt unit for the body frame, wherein the holding unit is provided at a belt unit frame side of the handle part, wherein the belt unit further comprises:

a first contacted part provided on the handle part to contact the first contacting part; and a second contacted part provided on one of the belt unit main frame and the belt unit side frame to contact the second contacting part, the second contacted part being closer to the second roller than the first roller, and wherein the holding unit comprises:

a lever member on which the first contacted part is provided; and an elastic member providing the lever member with a force to increase the contact pressure between the second contacting part and the second contacted part.

15. The image-forming device according to claim 14, wherein the handle part having a top end and a side end at the belt unit side frame, wherein the elastic member is a coil spring having an axis extending in a direction parallel to a line connecting the top end with the side end.

16. The image-forming device according to claim 15, wherein the lever member has a first arm receiving the force from the elastic member, a second arm on which the first contacted part is provided, and a curved part connecting the first arm with the second arm at an angle, and wherein in a state where the belt unit is mounted in the frame, a direction in which the first arm extends is orthogonal to a direction in which the axis extends and a direction in which the second arm extends is orthogonal to the first direction.

* * * * *